United States Patent [19]

Baltzer

[11] Patent Number: 4,831,695

[45] **Date of Patent: * May 23, 1989**

[54] APPARATUS FOR THE PRODUCTION OF SHORT WARPS ESPECIALLY FOR CLOTH DESIGNS IN MULTICOLOR WEAVING

[75] Inventor: Erich Baltzer, Nordhorn, Fed. Rep. of Germany

[73] Assignee: Hergeth Hollingsworth GmbH, Fed. Rep. of Germany

[ * ] Notice: The portion of the term of this patent subsequent to Aug. 4, 2004 has been disclaimed.

[21] Appl. No.: 80,262

[22] Filed: Jul. 31, 1987

Related U.S. Application Data

[63] Continuation of Ser. No. 881,661, Jul. 8, 1986, Pat. No. 4,683,625, which is a continuation of Ser. No. 582,042, Feb. 21, 1984, abandoned, which is a continuation-in-part of Ser. No. 185,963, Sep. 10, 1980, abandoned.

[30] Foreign Application Priority Data

Sep. 26, 1979 [DE] Fed. Rep. of Germany ..... 2938902

[51] Int. Cl.[4] ..... D02H 9/02

[52] U.S. Cl. ..... 28/191; 28/198

[58] Field of Search ..... 28/191, 198, 199, 291; 242/53

[56] References Cited

U.S. PATENT DOCUMENTS

| | | | |
|---|---|---|---|
| 1,641,288 | 9/1927 | Neidich | 242/53 |
| 1,798,363 | 3/1931 | Bischof | 28/198 |
| 3,323,189 | 6/1967 | Hayashi | 28/291 |
| 3,536,019 | 10/1970 | Honda et al. | 28/198 X |
| 4,683,625 | 8/1987 | Baltzer | 28/198 X |

FOREIGN PATENT DOCUMENTS

| | | | |
|---|---|---|---|
| 757787 | 4/1971 | Belgium | 28/191 |
| 45-21259 | 7/1970 | Japan | 28/198 |
| 47-46859 | 11/1972 | Japan | 28/198 |

*Primary Examiner*—Robert R. Mackey

*Attorney, Agent, or Firm*—Diller, Ramik & Wight

[57] ABSTRACT

A winding drum particularly adapted for the production of short warps, such as cloth designs in multicolor weaving, which includes a winding drum having an exterior peripheral surface upon which thread is wound, the winding drum including an axis of rotation about which the winding drum is rotated, a plurality of lease rods carried by the rotatable with a winding member, a plurality of bobbins each having a cord wound thereupon, the bobbins being carried by and rotatable with the winding member, each cord being connected to an associated lease rod, and the lease rods being mounted for parallel and transverse movement relative to the winding drum whereby any cord can be selectively adapted to define a demarcation zone between yarn wound in successive groups upon the winding drum peripheral surface.

21 Claims, 6 Drawing Sheets

APPARATUS FOR THE PRODUCTION OF SHORT WARPS ESPECIALLY FOR CLOTH DESIGNS IN MULTICOLOR WEAVING

This application is a continuation of application Ser. No. 881,664, filed July 3, 1986 and now U.S. Pat. No. 4,683,625, which is a continuation of Ser. No. 582,042 filed Feb. 21, 1984 and now abandoned, which is a continuation-in-part of Ser. No. 185,963 filed Sept. 10, 1980 and now abandoned.

BACKGROUND OF THE INVENTION

The invention relates to an apparatus for the production of warps, in particular for cloth designs, in multicolor weaving in side-by-side on a winding body such as a drum, and the yarns pass through thread crossing means during the winding operation. After the threads have been wound in a preselected number of loops around the winding element, the wound threads will be cut at their crossing points into separate warp lengths.

Such machines for the production of short warps serve the purpose of enabling a short yarn to be warped with but one bobbin per color, whereby there is a considerable saving in working time and material. The production of groups of yarns with the yarn colors changing over predetermined widths of the whole group allows the production of cloth designs to be carried out rationally, thus facilitating the production of samples.

In the case of one known kind of short warp warping frames (U.S. Pat. No. 3,247,568), the yarn winding guide is movable along the peripheral contour of the winding device at right angles to the direction of movement of the winding surface, whereas the carrier for the beam is stationary relative to the winding device. Moreover, the winding device is built up from at least two redirecting rollers which are arranged in spaced apart relationship and the relative spacing apart of which is adjustable. The warping machine is, moreover, provided with a transverse feeding belt operatively mounted on each one of a plurality of longitudinal peripheral members, said transverse feeding belts being movable in axial direction of the drum. Furthermore, the warping machine has a threaded spindle axially mounted in each one of the pair of drums, and it comprises coupling means mounted on the spindle and connected to the transverse feeding belts for moving the latter in the transverse feed direction of the wound thread. After all, the warping machine includes thread crossing means operatively mounted in said machine between the two winding elements.

In the case of another machine for producing warps (GB No. 1,323,320), there is used as a warping frame a winding former which is in the form of a drum with a conically ascending initial portion. The thread winding guide for the threads to be wound is arranged displaceably along the drum. Moreover, there is arranged over the circumference of the drum a flexible metal strip or separator strip which serves for the formation of leases or crossings, for instance, once at the beginning and once at the end of each section of threads.

The drum with the cone portion enables the winding of the group of yarns to be effected in lengths, whereby the winding can be continued without interruption from the start of the first length up to the end of the last length. The yarns are wound tightly after each finishing of a length up to the start of the next length. In doing so, there can be undertaken at least shortly before the finishing of a length a severance between the preceding windings and the winding or windings still to be produced. In the case of the known machine, the conical drum has a relatively large diameter of about 2 to 2.5 meters. The construction of the known device is complicated and expensive. The control of the advance of the lease rods and the apparatus for feeding the yarns to the drum is performed by separate driving means, the operation of which is harmonized to one another. The handling of the known device is involved. The equipment for the production of warps is relatively inefficient.

SUMMARY OF THE INVENTION

The invention provides a machine for the production of short warps, in particular for cloth designs in multicolor weaving which, along with compactness and a machine which is at the same time simple in construction and efficient. The invention is characterized in that, as an inverted U, the frame-shaped carriage surrounds the drum and is slidingly supported on guideways extending parallel to the axis of the drum, and the carriage is displaceable by means of a threaded spindle and spindle lock, the carriage comprising a detachably mounted holder section which carries a slide bar or slide rod being adjusted in height and adapted to keep the yarns separated, and a cam for a lease rod and an overrun rod.

Due to such a construction of the short warp warping machine, there is achieved a combination of substantial advantages. The embodiment of the carriage displaceable along the drum and surrounding the drum bilaterally permits it to mount all the elements and devices which, for the production of the warp sections, require a displacement in axial direction of the drum. This is applicable for holding the feeding apparatus for the group of threads with the warping reed and leasing reed and the arrangement of cams cooperating with lease rods and overrun rods serving for the formation of thread leases. At the same time, it is possible by simple means to operate at the frame carriage the individual devices independently of each other, the other devices remaining at rest. The resultant total equipment is considerably simplified. The various parts are easily accessible and their arrangement is well controllable. Only one element is used as a member for displacement in axial direction of the drum, namely, the carriage with which one or several elements required for the production of the short warp can be displaced optionally together or individually.

It is advisable to mount at the carriage a cam bar situated beneath the drum and adjustable in height.

According to another feature of the invention, the lease rods as well as the overun rod are mounted slidably at a plate which is connected to a portion of the shaft drivable in common with the drum. In this case, the guides for the rods are mounted to be adjustable in height corresponding to the height of the yarn package. At the same time, bobbins have been mounted on the plate. The bobbins carry wound cords which are secured to the rods (FIGS. 4 and 5).

BRIEF DESCRIPTION OF THE DRAWINGS

This invention will now be explained in more detail with reference to the drawings.

FIGS. 7*a* to 10*a* correspond to FIGS. 7 to 10 with the use of other lease rods and after the shed change for the supplied yarn groups and;

DESCRIPTION OF THE PREFERRED EMBODIMENT

Figure 1:
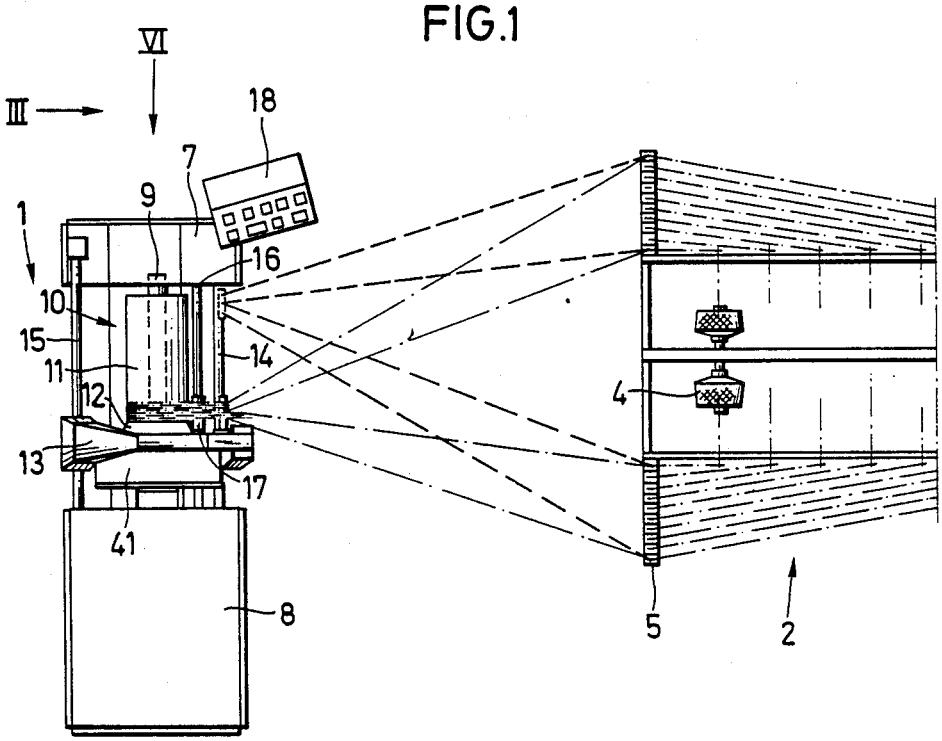
FIG. 1 shows a schematic plan view of the apparatus of the invention for warping short warps.
Figure 2:
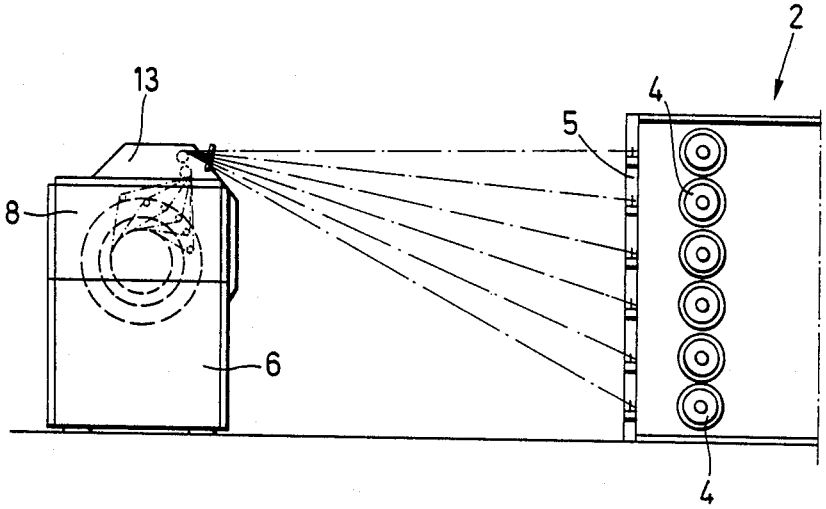
FIG. 2 is a schematic view of the warping machine with a warper's creel according to the arrangement of FIG. 1.
Figure 3:
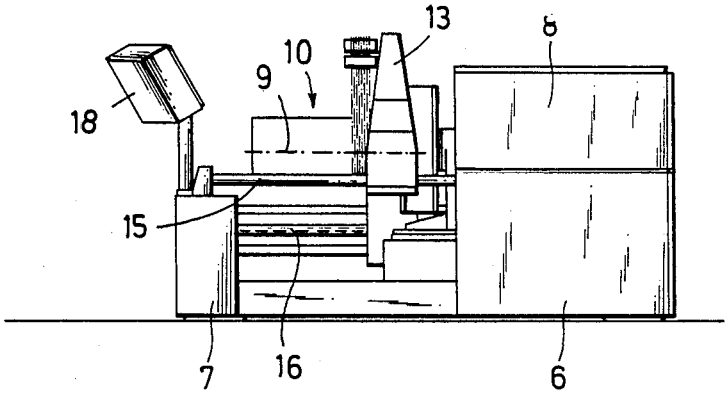
FIG. 3 is a schematic side view of the warping machine as viewed from the direction of the arrow III of FIG. 1.

The apparatus for producing short warps, in particular for cloth designs in multicolor weaving and for forming a sample warp with customary warp width includes a warping machine 1 associated with a warper's creel 2 on which a predetermined number of cross wound bobbins 4 is supported whose yarns are guided through a comb 5. The individual yarns are guided to the warping machine 1 via yarn guide members and yarn stop-motions (unillustrated).

The warping machine 1 includes a machine frame 6, 7 with conventional drive means including a drive and gear box mechanism 8. A drum 10 is arranged to be slid and locked on a shaft 9 driven by the drive means 8. The drum includes a cylindrical portion 11 and a cone portion 12 joined thereto. A carriage 13 formed in the manner of a frame is mounted for sliding movement on guideways 14 and 15 to be displaceable lengthwise of the axis of the drivable shaft 9, the advance being effected by sliding motion imparting means defined by a threaded spindle 16 with a spindle lock 17. Built into a control board 18 are the conventional electrical control devices for a program control and all important measuring and indicating appliances. The advance drive of carriage 13 is independent of the rotating drive of the drum.

Carriage 13 which surrounds drum 10 is provided with supporting means or lugs 20 and 21 to which a supporting plate 22 is secured by means of screws 20*a*, whereby the supporting plate or carrier section 22 is detachably secured to the carriage 13. A slide rod 23 is connected to the supporting plate 22 and includes a projecting pin or or end 23*a*. The slide rod 23 extends generally parallel to the shaft 9 of the drum 10. The slide rod 23 is guided displaceably in a guide 25 by means of mounting elements 23*b* and 23*c*. The guide 25 is firmly secured to the supporting plate 22. The slide rod 23 can be adjusted in height generally transverse to the axis of the drum 10 by means of a pneumatic lifting piston cylinder 24 whose piston 24*a* is connected to the mounting element 23*c*. The slide rod 23 is moved generally parallel to the axis of the drum 10 by manual movement of the support plate 22 or through pneumatic cylinder means diagrammatically indicated by the unnumbered double-headed arrows in FIGS. 9 and 10, in the longitudinal direction of the shaft 9 of the drum 10. The slide rod 23 functions to separate upper and lower yarn sheets from each other, as will be discussed more fully hereinafter with respect to FIGS. 7 through 10 of the drawings. Furthermore, to the supporting plate 22, a cam 26 is connected and slidingly supported in vertical direction in a sleeve 28. By means of a pneumatic lifting cylinder 29, the cam 26 can be adjusted in height. The cam 26 is meant to engage with an overrun rod 27 which stabilizes a first-formed yarn package incident to the formation of a new yarn package, as will be described more fully hereinafter.

Therefore, through the operation of the cam 26, the overrun rod 27 can be placed upon any formed yarn package to stabilize the same incident to the formation of a new yarn package subsequently formed on the drum 10.

Figure 6:
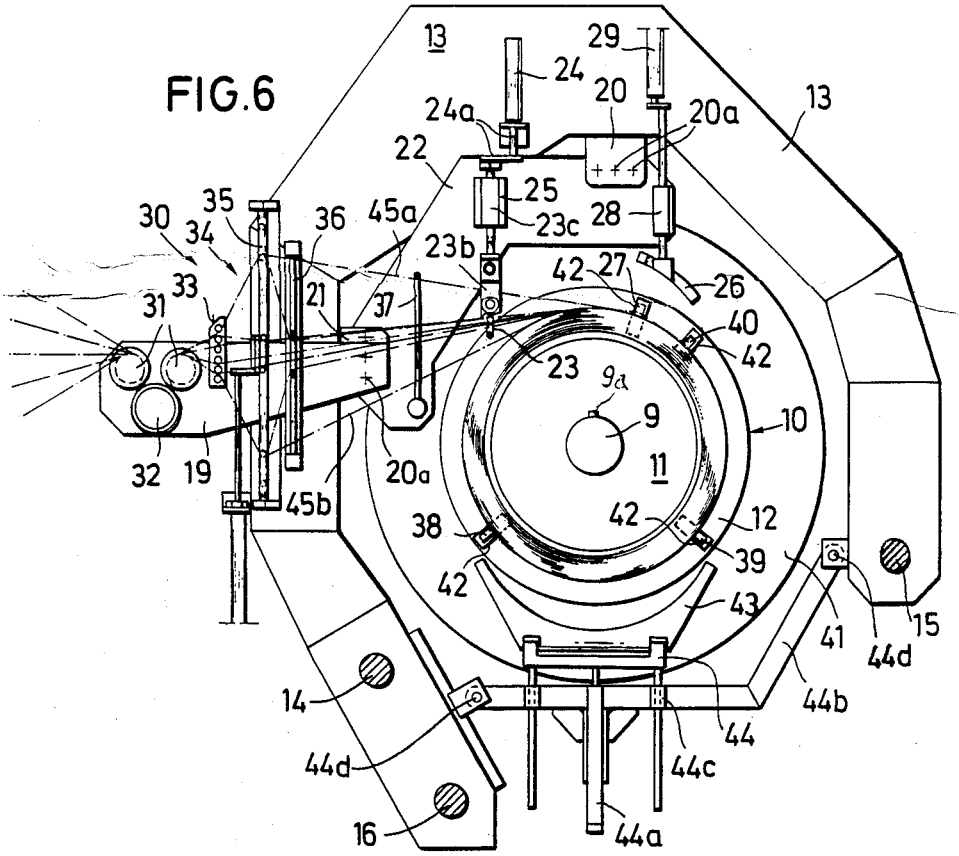
FIG. 6 is a schematic view looking at the warping machine in direction of arrow VI of FIG. 1, and illustrates the warping device in accordance with the lease or crossing method of operation, partly cut away and scaled up.

From the foregoing, it is to be noted that the slide rod 23 is simply a slide which moves between the upper yarn sheet 45*a* (FIGS. 7 through 10) and the lower yarn sheet 45*b* to spread these two yarn sheets and, thus, function as an aid to facilitate the introduction of the lease rods 38, 39 and/or 39, 40 between the yarn sheets and the space 54 (FIG. 9) during leasing. The lease rods 38, 39 and 40 are, of course, operated in a conventional fashion to produce the leasing or yarn crossings. The slide rod 23 moves transversely relative to the drum 10 and the shaft 9 thereof simply through the mechanisms 24, 24*a*, 25, 23*c* and 23*b* (FIG. 6). The element 25 is a guide firmly fixed to the carriage section 22 which is in turn connected by supporting lugs 20 to the carriage 13. Thus, as the carriage 13 is displaced longitudinally in the direction of the arrows associated with the slide rod 23 in FIGS. 9 and 10 for movement along the guides or guideways 14, 15, the slide rod 23 is likewise longitudinally displaced therewith. The means or threads 16 impart sliding motion to the carriage 13 along its guideways 14, 15 and, thus, similarly displace the slide rod 23.

Beneath the drum 10, carriage 13 is provided with a striker bar 43 which is adjustable in height and which is secured to a carrier bracket 44 slidingly guided in the struts 44*b* and 44*c*. Said strut 44*b* is fastened to the carriage 13 at points 44*d*. A pneumatic lifting cylinder 44*a* engages the carrier bracket 44 to adjust it in height. The width of the striker bar 43 is such as to permit the coaction of its legs with the lease rods 38 and 39 or 39 and 40 provided in a predetermined spaced relationship.

Figure 5:
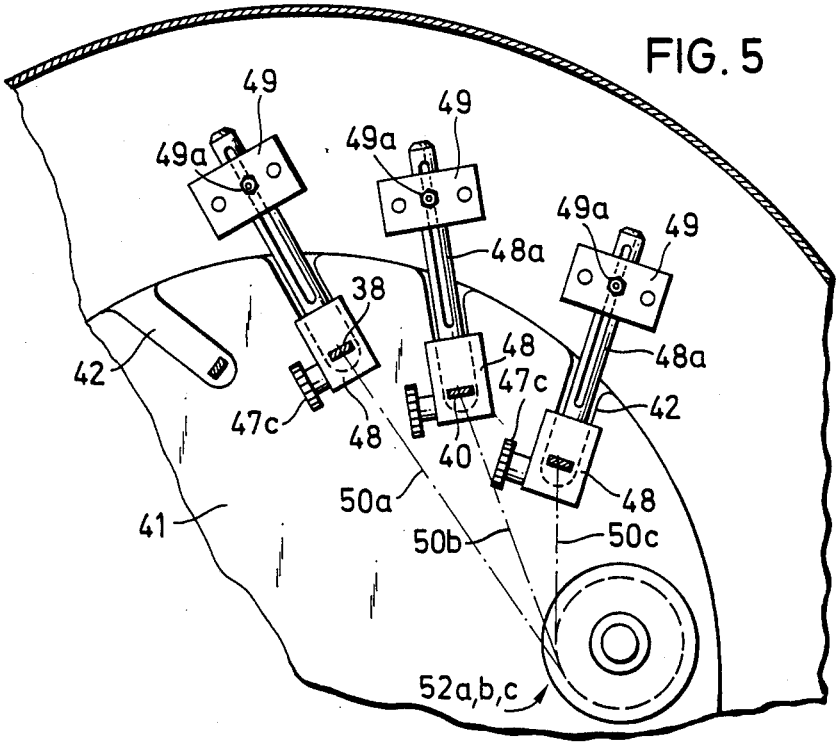
FIG. 5 is a view taken along line V—V of FIG. 4.
Figure 11:
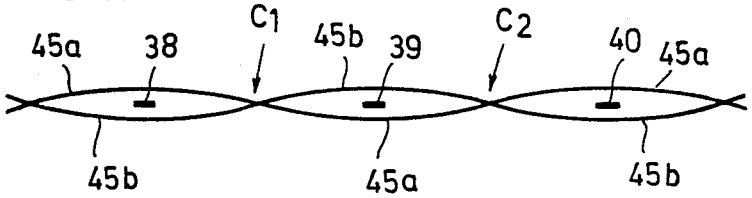
FIG. 11 illustrates the yarn groups at the beginning and end respectively of a warped yarn band with yarn crossings.
Figure 7:
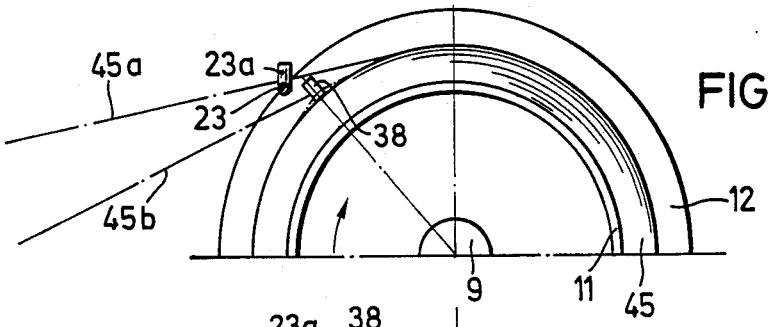
FIGS. 7 and 8 illustrate schematically and in end elevation two phases for the formation of a lease or crossing by means of a slide bar and of a lease rod.

The lease rods 38, 39 and 40 are shown in different locations in FIGS. 5 and 6 simply as a matter of convenience, and spacing therebetween can vary so long as there is sufficient spacing to permit yarn crossings, such as at C1, C2 in FIG. 11. Thus, the crossings C1, C2 will occur at closer distances if the lease rods 38, 39 and/or 40 are shown positioned closer to each other (FIG. 5) than at further distances from each other (FIG. 6).

A device 30 defining means for guiding the yarns is provided at a plate 19 of the carriage 13. It may include feed rollers 31, a measuring roller 32, a reed 33 with transverse rods, a heald frame 34 with shafts or shaft means 35 for the shed formation and a leasing reed 36. Due to the heald frame 34 in connection with the leasing reed 36, the warp yarns are combined into groups which are lifted or lowered. Reference numeral 37 refers to a warping comb which is mounted at the supporting plate 22.

Figure 4:
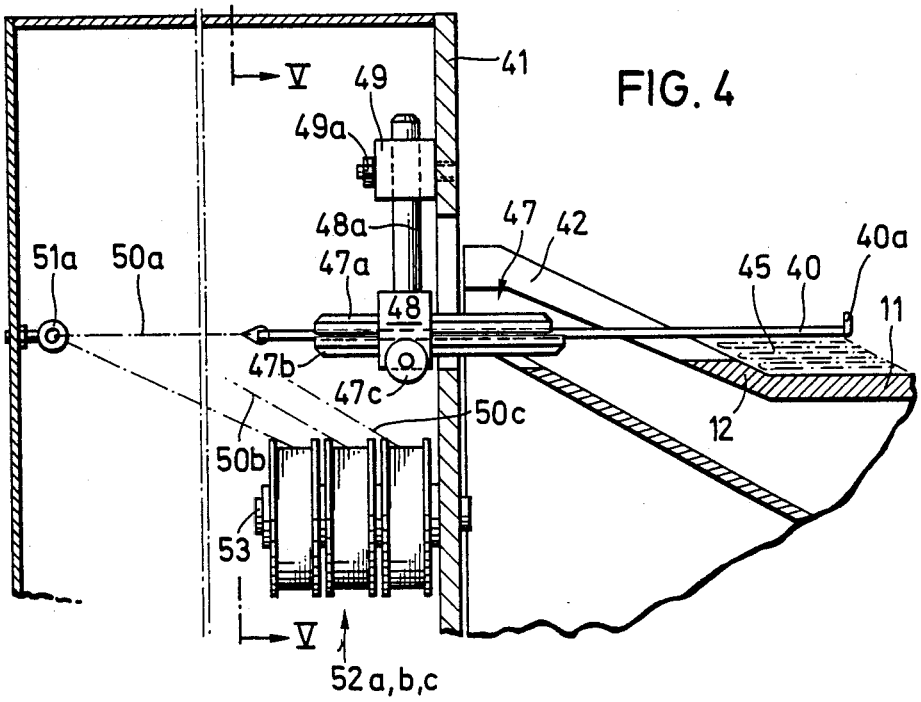
FIG. 4 shows a schematic embodiment of the arrangement of lease rods and of the overrun rod at the mounting for the cone drum.

As evident from FIGS. 4 and 5, the lease rods of which the lease rod 40 is shown as an example, are slidingly supported in a guide 47 which is formed by jaws 47*a* and 47*b* which are carried by a mounting support 48 carried by the end wall 41 which rotates with the drum 10. Reference numerals 47*c* shows a screw for fixing the jaws 47*a* and 47*b* in the mounting support. Said mounting support 48 includes slotted guide bars 48*a* which can be adjusted in radial direction in a mounting 49 stationarily provided at the front end wall 41 of a housing and which can be arrested by means of a screw 49*a*. The cone portion 12 of drum 10 is provided with a predetermined number of slots 42 through which the lease rods are guided such as evident from FIG. 4 in regard to the lease rod 40. To the rear ends of the lease rods 38, 39, 40, cords 50*a, b, c* are attached which are led through respective yarn eyes 51*a, b, c* to extend to supply bobbins 52*a, b, c* which are supported rotatingly on a shaft 53.

The distance of the lease rods 38, 39, 40 from the peripheral surface of the cylindrical portion 11 of the drum 10 is dictated by the thickness of yarn package to be applied on the drum. The projection of the lease rods 38, 39, 40 beyond the conical portion 12 of the drum is manually adjusted at the beginning of the operation in that the lease rod is extracted more or less out of the jaws 47*a*, 47*b*. To ensure that all lease rods with their upstanding end portions (see 40*a*, FIG. 4) are positioned in one common transverse plane relative to the drum, the cams 26 and 43 are displaced towards the drum until they get into the region of the bent ends (see 40*a* of lease rod 40) or engage behind said bent ends. Subsequently, when carriage 13 together with cams 26, 43 is displaced in axial direction of shaft 9, one can be sure that all of the lease rods are situated in the same transverse plane to the drum.

The warping operation is effected as follows:

The yarns situated side-by-side to form a yarn sheet of the desired width are supplied via the feed rollers 31 to the cylindrical drum 10 and fastened by bonding or by adhesive tape at the start of the cone portion of said drum 10. In switch-on position of the machine, the first package is prepared by displacing the carriage 13 towards the cone portion 12. The resultant yarn package ascends obliquely such as evident from FIG. 4 so that the outward yarns are prevented from slipping down. The lease rods 38, 39, 40 are introduced manually into the clamping jaws 47 at the height of the package and may be adjusted exactly in height by means of the mechanism 48, 49.

Figure 8:
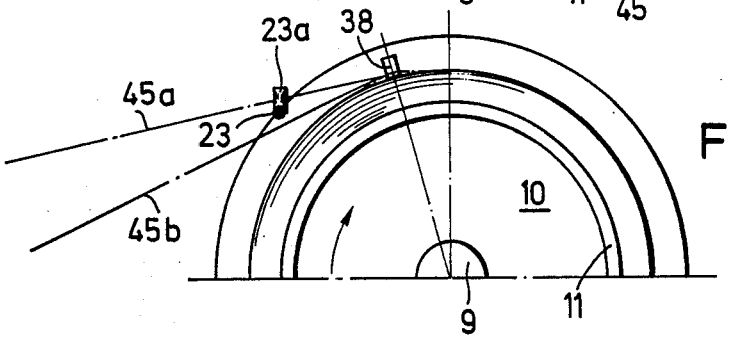
Figure 9:
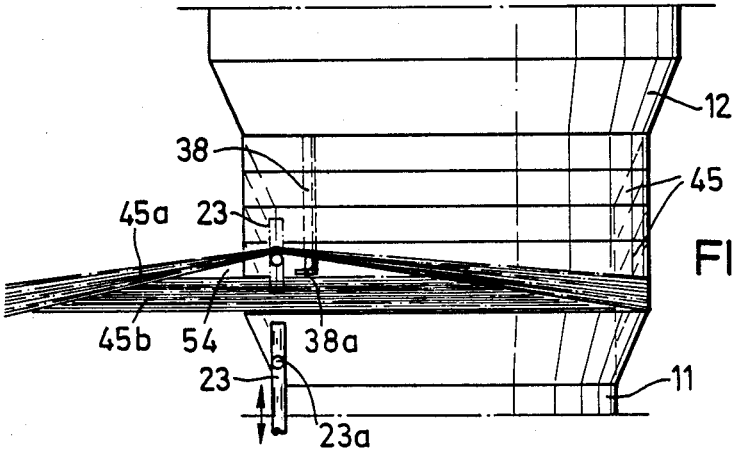
FIGS. 9 and 10 show a schematic plan view of the stages illustrated in respect of FIGS. 7 and 8.
Figure 10:
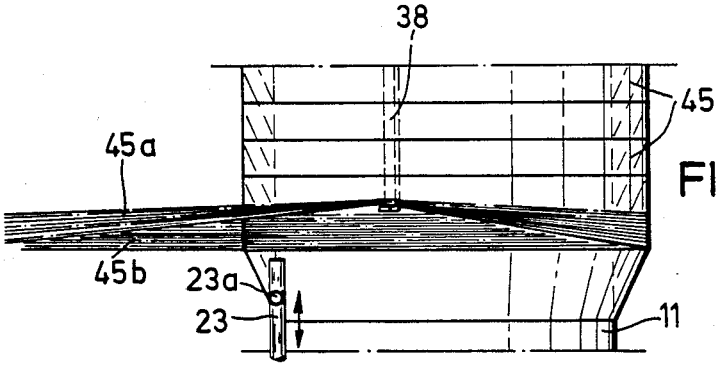
Figure 7A:
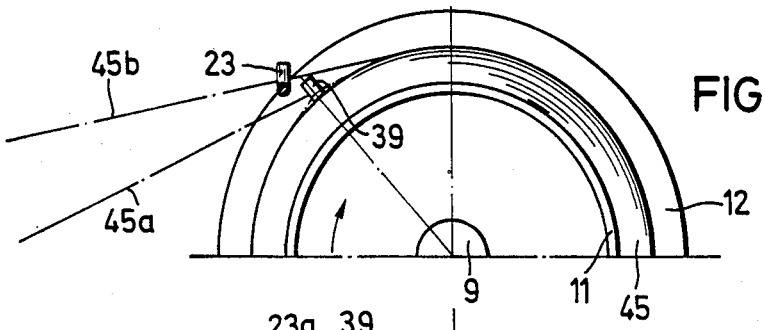
Figure 8A:
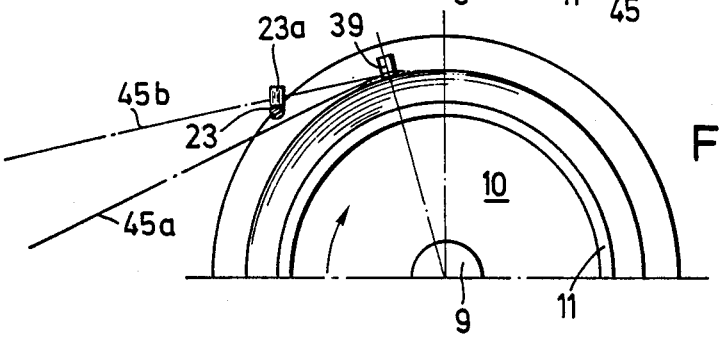

Due to the shedding devices 34 and 36, the yarn sheet (FIGS. 7 to 10) is divided into a group 45*a* situated at the top and a group 45*b* situated at the bottom, the respective upper yarn sheet being conducted over the slide rod 23. With the next shedding change by the heald frame 34, the yarn sheet 45*a* previously situated in the upper position will be in the down position while the yarn sheet 45*b* previously situated in the lower position will get into the upper position over the slide rod 23. Starting from the position of the yarn sheets 45*a* and 45*b* in FIGS. 7 to 10, the yarn sheet 45*a* is at the top over the slide rod 23. To provide yarn crossings at the end of the yarn package formed on drum 10, the upper yarn sheet 45*a* is pushed back by the slide rod 23 with the projecting portion 23*a* by longitudinal displacement in axial direction of the drum 10, such as evident from FIG. 9. Drum 10 will be now rotated clockwise for a partial distance by means of the drive. By said rotation, the lease rod 38 with its bent end portion 38*a* gets into the cleared space 54 from below beneath the upper yarn sheet 45*a* so that the latter can be taken in charge by the lease rod 38 to rest on it. As a result thereof, the slide rod 23 of the yarn sheet 45*a* may be urged to take the withdrawn position (FIGS. 8 and 10). The yarn sheet 45*a* is now disposed on the lease rod 38 (such as shown in FIG. 10) whereupon the drum 10 is somewhat rotated clockwise whereby the lease rod 38 is guided past the apex of the drum 10 so as to be farther away from the heald frame 34 or from the reed 36. As a result thereof, the oblique position of the upper yarn sheet 45*a* relative to the lower yarn sheet 45*b* will be reduced so that the yarn sheets extend practically in parallel relative to each other at least near the heald frame 34, respectively, and the reed 36.

Figure 9A:
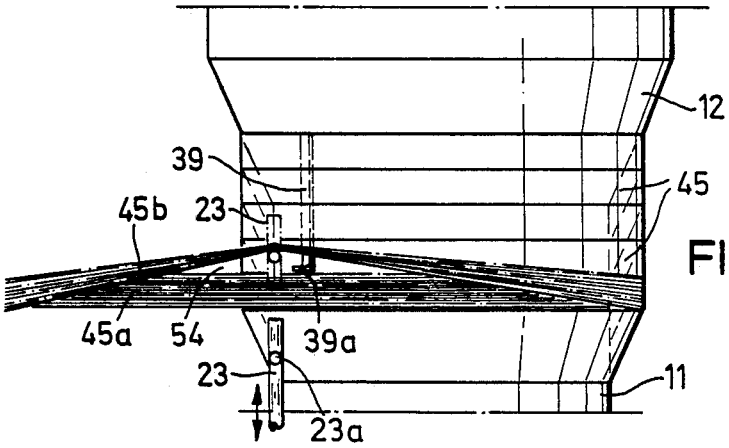
Figure 10A:
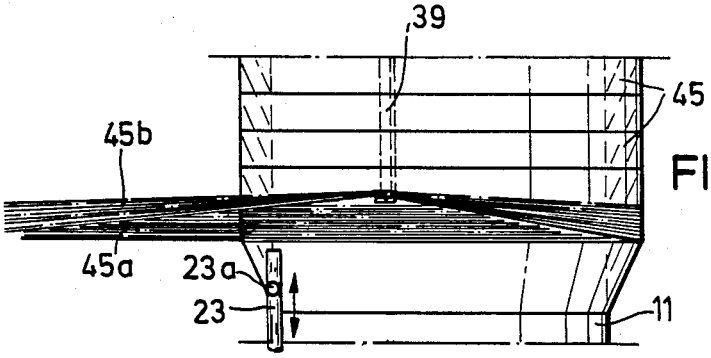

With the next shedding by means of the heald frame 34, the yarn sheets extend practically in parallel relative to each other, the yarn sheet 45*b* situated previously below getting into the upper position, while the yarn sheet 45*a* will take the lower position (FIGS. 7*a* to 10*a*). By a displacement parallel to shaft 9, the slide rod 23 is moved so far that the yarn sheet 45*b* situated now above will be engaged and pressed aside in regard to the lower yarn sheet 45*a* in axial direction of the drum (FIG. 9*a*). By means of the drive, drum 10 has been rotated clockwise so that the next lease rod 39 will be first situated where lease rod 38 was located at the beginning of the operation according to FIG. 9. Thus, during the rotation of the drum 10, lease rod 39 may get from below beneath the yarn sheet 45*b* displaced in axial direction of drum 10 by the slide rod 23 with the bent portion 23*a* into the resultant formed free opening 54 (FIG. 9*a*), while the slide rod 23 may be urged again by displacement into the withdrawn position (FIG. 10*a*).

The same operation will be repeated in connection with lease rod 40 which, by the intermittent partial rotation of the drum has reached the starting position of lease rod 38 of FIG. 6. First off, a shedding change is performed again by the heald frame 34 and device 36, and, in conformity with FIGS. 7 to 10, the lower yarn sheet 45*a* will get into the upper position while the upper yarn sheet 45*b* will then occupy the lower position. The axial resetting of the respective upper yarn sheet relative to the respective lower yarn sheet by means of the bent portion 23*a* of the slide rod 23 as illustrated in FIGS. 9, 9*a* is only performed as a facilitating measure so that, with the respective partial rotation of drum 10, the lease rod may safely get from below beneath the respective upper yarn sheet thus ensuring that the respective upper yarn sheet will rest on the lease rod.

By this means, two crossing points of the yarn groups (yarn crossings) may be formed (points C1 and C2 of FIG. 11) with the aid of the three lease rods 38, 39, 40.

Subsequently, a new package can be started on the cylindrical portion 11 of the drum. To this effect, the yarn sheet will be conducted downwardly relatively steeply from the peripheral surface of the furnished yarn package to the adjacent peripheral surface of the cylindrical drum portion 11 by means of the advance of the carriage 13 carrying the yarn guidances 30 to 37.

Upon a setting of the cams 26 and 43 to the height of the finished yarn package, the lease rods 38, 39, 40 may be taken along by the width of the yarn package toward the drum end during the displacement of carriage 13, the cams 26, 43 engaging behind the bent ends of the lease rods. Subsequently, said cams 26, 43 are withdrawn in radial direction by means of the peneumatic cylinders 29, 44*a*. Said operations for the preparation of the yarn package are repeated.

Upon releasing the locking means 9*a*, the warping drum will be removed from the shaft 9, while an empty warping drum will be placed on the shaft to be arrested in position. The yarns fastened by knots at the warping comb 37 are untied, supplied to the cylindrical drum portion 11 and fastened again before the cone start 12. Prior to a new warping operation, the lease rods 38, 39 and 40 are withdrawn from the formed yarn package and are inserted manually into the guides 47 to be connected to the cords 50*a, b, c* and to be placed into their starting positions. Thereafter, warping may begin for the yarn package section as described above. Preferably, the length of the drum should be about 600 millimeters while its diameter should be about 400 to 500 millimeters.

I claim:

1. A winding drum particularly adapted for the production of short warps, such as cloth designs in multicolor weaving, comprising a winding member having an exterior peripheral surface upon which thread is adapted to be wound, said winding member including an axis of rotation about which said winding member is adapted to rotate, a plurality of lease rods rotatable with said winding member, a plurality of bobbins each having a cord wound thereupon, said plurality of bobbins being rotatable with said winding member, and each cord being connected to an associated lease rod.

2. The winding drum as defined in claim 1 including means for mounting said lease rods for movement generally parallel to said winding member axis.

3. The winding drum as defined in claim 1 including means for mounting said lease rods for sliding movement generally parallel to said winding member axis.

4. The winding drum as defined in claim 1 including means for mounting said lease rods for reciprocal sliding movement generally parallel to said winding member axis.

5. The winding drum as defined in claim 1 including means for mounting said lease rods for movement generally parallel to said winding member axis, and said lease rod mounting means being each defined by a jaw which slidably receives an associated lease rod.

6. The winding drum as defined in claim 1 including means for mounting said lease rods for movement generally transverse to said winding member axis.

7. The winding drum as defined in claim 1 including means for mounting said lease rods for sliding movement generally transverse to said winding member axis.

8. The winding drum as defined in claim 1 including means for mounting said lease rods for reciprocal sliding movement generally transverse to said winding member axis.

9. The winding drum as defined in claim 1 including means for mounting said lease rods for movement generally transverse to said winding member axis, and means for locating each lease rod mounting means at a selected one of a plurality of different postions of adjustment thereof generally transverse to the winding member axis.

10. The winding drum as defined in claim 1 including means for mounting said lease rods for movement generally parallel and transverse to said winding member axis.

11. The winding drum as defined in claim 1 including means for mounting said lease rods for movement generally parallel and transverse to said winding member axis, said lease rod mounting means being each defined by a jaw which slidably receives an associated lease rod and means for locating each lease rod mounting means at a selected one of a plurality of different positions of adjustment thereof generally transverse to the winding member axis.

12. The winding drum as defined in claim 1 including means for mounting said lease rods for sliding movement generally parallel and transverse to said winding member axis.

13. The winding drum as defined in claim 1 including means for mounting said lease rods for reciprocal sliding movement generally parallel and transverse to said winding member axis.

14. The winding drum as defined in claim 1 including a plurality of generally axially extending slots in said winding member, each receiving an associated one of said lease rods.

15. The winding drum as defined in claim 1 including a plurality of generally axially and radially extending slots in said winding member, each receiving an associated one of said lease rods.

16. The winding drum as defined in claim 1 wherein said winding member peripheral surface includes first and second peripheral surface portions upon which yarn is adapted to be wound, the diameter of said first peripheral surface portion being greater than the diameter of said second peripheral surface portion, and a plurality of generally axially extending slots in said winding member extending axially through said first peripheral surface portion and receiving therein an associated one of said lease rods.

17. The winding drum as defined in claim 16 wherein said first peripheral surface portion is conical.

18. The winding drum as defined in claim 17 including means for mounting said lease rods for movement generally parallel to said winding member axis, and said lease rod mounting means being each defined by a jaw which slidably receives an associated lease rod.

19. The winding drum as defined in claim 16 wherein each lease rod includes opposite first and second end portions, each first end portion having an associated cord attached thereto, and each second end portion being in generally transversely spaced relationship to said second peripheral surface portion.

20. The winding drum as defined in claim 1 wherein said winding member peripheral surface includes first and second peripheral surface portions upon which yarn is adapted to be wound, the diameter of said first peripheral surface portion being greater than the diameter of said second peripheral surface portion, and a plurality of generally radially extending slots in said winding member extending radially through said first peripheral surface portion and receiving therein an associated one of said lease rods.

21. The winding drum as defined in claim 1 wherein said winding member peripheral surface includes first and second peripheral surface portions upon which yarn is adapted to be wound, the diameter of said first peripheral surface portion being greater than the diameter of said second peripheral surface portion, and a plurality of generally axially and radially extending slots in said winding member extending axially and radially through said first peripheral surface portion and receiving therein an associated one of said lease rods.

* * * * *